US007863557B2

(12) United States Patent
Brown

(10) Patent No.: US 7,863,557 B2
(45) Date of Patent: Jan. 4, 2011

(54) MASS SPECTROMETER

(75) Inventor: Jeffery Mark Brown, Cheshire (GB)

(73) Assignee: Micromass UK Limited, Manchester (GB)

( * ) Notice: Subject to any disclaimer, the term of this patent is extended or adjusted under 35 U.S.C. 154(b) by 225 days.

(21) Appl. No.: 12/282,394

(22) PCT Filed: Mar. 14, 2007

(86) PCT No.: PCT/GB2007/000905

§ 371 (c)(1),
(2), (4) Date: Nov. 20, 2008

(87) PCT Pub. No.: WO2007/104992

PCT Pub. Date: Sep. 20, 2007

(65) Prior Publication Data

US 2009/0314934 A1 Dec. 24, 2009

Related U.S. Application Data

(60) Provisional application No. 60/787,101, filed on Mar. 29, 2006.

(30) Foreign Application Priority Data

Mar. 14, 2006 (GB) ..... 0605089.2

(51) Int. Cl.
*H01J 49/42* (2006.01)
*H01J 49/22* (2006.01)

(52) U.S. Cl. ..... 250/281; 250/282; 250/283; 250/288; 250/396 R; 250/397; 250/423 R

(58) Field of Classification Search ..... 250/281, 250/282, 283, 396 R, 397, 288
See application file for complete search history.

(56) References Cited

U.S. PATENT DOCUMENTS 6,998,606 B2 * 2/2006 Buttrill, Jr. ..... 250/287
7,247,846 B2 * 7/2007 Buttrill, Jr. ..... 250/287

(Continued)

FOREIGN PATENT DOCUMENTS

JP 2000243345 9/2000

(Continued)

OTHER PUBLICATIONS

Toyda, Michisato, et al; Multi-turn time-of-flight mass spectrometers with electrostatic sectors; J. Mass Spectrom, vol. 38, Jan. 1, 2003, pp. 1125-1142.

(Continued)

*Primary Examiner*—Nikita Wells
(74) *Attorney, Agent, or Firm*—Jamie H. Rose

(57) ABSTRACT

A multi-turn Time of Plight mass analyzer is disclosed comprising a first electric sector (5) and a second electric sector (8). The second electric sector (8) is arranged orthogonal to the first electric sector (5). Ions may make multiple loops or circuits of the mass analyzer before being detected and mass analyzed enabling a high resolution mass analyzer to be provided. According to another embodiment the mass analyzer may have an open-loop geometry wherein the first electric sector is elongated and further electric sectors are arranged in a staggered manner along the length of the first electric sector. The first and second electric sectors (5,8) may be sub-divided into a plurality of electric sector segments.

14 Claims, 4 Drawing Sheets

U.S. PATENT DOCUMENTS

| | | | | |
|---|---|---|---|---|
| 7,427,752 | B2 * | 9/2008 | Jones et al. | 250/299 |
| 2005/0045817 | A1 | 3/2005 | Yamaguchi et al. | |

FOREIGN PATENT DOCUMENTS

| | | |
|---|---|---|
| JP | 2001143655 | 5/2001 |

OTHER PUBLICATIONS

Ishihara, Morio, et al; Perfect space and time focusing ion optics for multiturn time of flight mass spectrometers; International Journal of Mass Spectrometry 197 (2000) 179, 189, pp. 179-189.

* cited by examiner

MASS SPECTROMETER

CROSS REFERENCE TO RELATED APPLICATIONS

This application is the National Stage of International Application No. PCT/GB2007/000905, filed Mar. 14, 2007, which claims priority to and benefit of U.S. Provisional Patent Application Ser. No. 60/787,101, filed Mar. 29, 2006, and priority to and benefit of United Kingdom Patent Application 0605089.2, filed Mar. 14, 2006. The entire contents of these applications are incorporated herein by reference.

The present invention relates to a mass analyser and a method of mass analysing ions.

The preferred embodiment relates to a compact Time of Flight mass analyser having a high mass resolution. The flight path of the preferred mass analyser is preferably very long and ions are preferably arranged to complete multiple circuits or orbits around the mass analyser. The mass analyser preferably comprises two electric sectors which are preferably arranged orthogonal to each other. The geometry of the mass analyser is arranged so as to substantially prevent ions from diverging spatially. According to a preferred embodiment one or more of the electric sectors may be sub-divided into a plurality of electric sector segments each having a sector angle. The sum of the sector angles is preferably 180°.

Time of Flight ("TOF") mass spectrometers incorporating a Matrix Assisted Laser Desorption Ionisation ("MALDI") ion source or an Electrospray Ionisation ion source have become powerful analytical instruments especially in biochemistry and proteomics. Inherent features of such mass spectrometers include high sensitivity, theoretically unlimited mass range and rapid measurement capabilities. Accordingly, Time of Flight mass spectrometers have significant potential advantages compared with other types of mass spectrometers such as quadrupole, ion trap and magnetic sector mass spectrometers. However, the mass resolving power of conventional commercial Time of Flight mass analysers is not as high as high performance Fourier Transform Ion Cyclotron Resonance ("FT-ICR") mass spectrometers. FT-ICR mass spectrometers are known which are capable of achieving resolving powers as high as 100,000 FWHM enabling improved mass measurement accuracy in data where peaks would otherwise overlap in lower resolution instruments.

The mass resolving power R of a Time of Flight mass analyser is defined as:

$$R=m/\Delta m=t/2\Delta t \quad (1)$$

wherein t is the total time of flight and $\Delta t$ is the peak width measured at Full Width Half Maximum ("FWHM").

For ions having the same mass, the peak width is due to aberrations originating from the energy and spatial spread of the initial ion packet volume, the response time of the ion detector, electric field imperfections, detector flatness tolerances and ion packet divergence caused by collisions with residual gas molecules.

It is known to attempt to apply various ion optical techniques in order to minimise the final peak width. For example, ions having a relatively high kinetic energy may be arranged to travel through a slightly longer flight path so that such ions arrive at the ion detector at substantially the same time as ions having relatively low kinetic energies.

It can be seen from Eqn. 1 above that in theory lengthening the flight path, and hence the flight time of ions, will result in a proportional increase in resolution provided that the peak width stays approximately the same. However, in practice, lengthening the flight path by any significant factor is impractical in a commercial instrument since the resulting mass analyser will become prohibitively large and expensive. A further problem is that most commercial Time of Flight mass analysers do not attempt to contain the radial divergence of the ion beam. Accordingly, simply increasing the length of the flight path will result in a corresponding increase in the diameter of the final ion packet. This will, in turn, require the diameter of the microchannel plate (MCP) ion detector to be increased proportionally in size thereby further significantly increasing the cost and complexity of the mass analyser. A mass analyser having a large ion detector is impractical for a commercial instrument.

A known commercial mass spectrometer (Q-TOF® produced by Waters, Inc.®) increases the effective flight path of a Time of Flight mass analyser by causing ions to make two separate passes through an ion mirror comprising a reflectron. This effectively doubles the mass resolution of the mass spectrometer to approximately 30,000 FWHM.

Various conceptual multi-turn Time of Flight mass analysers have been proposed in the past. However, such concepts have not been commercialised because of the above mentioned practical difficulties.

A significant problem with known theoretical concepts for a multi-turn Time of Flight mass analyser is that there is no mechanism for ensuring that an ion packet does not expand after multiple orbits. Ions therefore need to be spatially re-focussed. Furthermore, in addition to being spatially re-focused, an ion packet should also not expand in any direction as a result of the initial energy spread of ions. This focusing condition has been termed perfect focusing and will be discussed in more detail below. If perfect focusing is not achieved then ion transmission and resolution will quickly deteriorate as ions make increasing number of orbits or cycles around the mass analyser.

Another problem which needs to be addressed is that ions having relatively low mass to charge ratios will overtake ions having relatively high mass to charge ratios after a number of orbits around a multi-turn Time of Flight mass analyser. Consequently, it will become difficult to determine the masses of the peaks in the resultant mass spectrum even though the peaks may be highly resolved.

For completeness, it should be mentioned that FT-ICR mass spectrometers are known which have very long effective ion flight paths. However, a FT-ICR mass spectrometer should not be construed as being a Time of Flight mass analyser within the meaning of the present invention. FT-ICR mass spectrometers measure the period of cyclotron motion of an ion within a magnetic field. The cyclotron frequency is inversely proportional to the mass of the ion. In FT-ICR mass spectrometers, ions are initially shocked into closed orbits by an electric pulse and are caused to oscillate at their respective cyclotron frequencies. Ions are then detected by listening to them "ring". As an ion approaches a metal surface of an ion detector the ion will induce a charge on the surface of the ion detector. An induced charge will move to the surface of the ion detector from ground. As the induced charge passes through a resistor or inductor a voltage signal is generated. The voltage signal is relatively complex in time since a large number of ions having different cyclotron frequencies will contribute to the voltage signal. However, Fourier analysis of the complex voltage signal enables the masses and relative abundance of the various ions to be determined.

It is desired to provide an improved mass analyser.

According to an aspect of the present invention there is provided a mass analyser comprising:

a first electric sector; and a second electric sector, wherein the second electric sector is arranged orthogonal to the first electric sector.

According to an embodiment the first electric sector may comprise a single electric sector. The first electric sector may comprise, for example, a 180° electric sector.

According to another embodiment the first electric sector may comprise a plurality of first electric sector segments. The first electric sector may comprise two, three, four, five, six, seven, eight, nine, ten or more than ten first electric sector segments. Preferably, one or more of the first electric sector segments has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°. The plurality of first electric sector segments each have a sector angle and the sum of the sector angles of the plurality of first electric sector segments is preferably 180°.

According to the preferred embodiment the first electric sector may comprise a semi-cylindrical electric sector comprising a first curved plate electrode and a second curved plate electrode. In a mode of operation the first curved plate electrode of the first electric sector is preferably maintained at an opposite polarity to the second curved plate electrode of the first electric sector.

In a mode of operation the first curved plate electrode of the first electric sector is preferably maintained at a potential selected from the group consisting of: (i) 0 V; (ii) 0-20 V; (iii) 20-40 V; (iv) 40-60 V; (v) 60-80 V; (vi) 80-100 V; (vii) 100-120 V; (viii) 120-140 V; (ix) 140-160 V; (x) 160-180 V; (xi) 180-200 V; (xii) 200-300 V; (xiii) 300-400 V; (xiv) 400-500 V; (xv) 500-600 V; (xvi) 600-700 V; (xvii) 700-800 V; (xviii) 800-900 V; (xix) 900-1000 V; (xx) 1-2 kV; (xxi) 2-3 kV; (xxii) 3-4 kV; (xxiii) 4-5 kV; and (xxiv) >5 kV. In a mode of operation the second curved plate electrode of the first electric sector is preferably maintained at a potential selected from the group consisting of: (i) 0 V; (ii) 0 to −20 V; (iii) −20 to −40 V; (iv) −40 to −60 V; (v) −60 to −80 V; (vi) −80 to −100 V; (vii) −100 to −120 V; (viii) −120 to −140 V; (ix) −140 to −160 V; (x) −160 to −180 V; (xi) −180 to −200 V; (xii) −200 to −300 V; (xiii) −300 to −400 V; (xiv) −400 to −500 V; (xv) −500 to −600 V; (xvi) −600 to −700 V; (xvii) −700 to −800 V; (xviii) −800 to −900 V; (xix) −900 to −1000 V; (xx) −1 to −2 kV; (xxi) −2 to −3 kV; (xxii) −3 to −4 kV; (xxiii) −4 to −5 kV; and (xxiv) <−5 kV.

The mass analyser preferably further comprises an ion inlet port provided in the first electric sector, wherein in use ions from an ion source are preferably introduced into the mass analyser via the ion inlet port.

The first electric sector is preferably arranged to receive ions being transmitted in a first direction and is preferably arranged to eject ions in a second direction which is preferably opposite to the first direction.

According to an embodiment the second electric sector may comprise a single electric sector. The second electric sector may comprise, for example, a 180° electric sector.

According to another embodiment the second electric sector may comprise a plurality of second electric sector segments. The second electric sector may comprise two, three, four, five, six, seven, eight, nine, ten or more than ten second electric sector segments. Preferably, one or more of the second electric sector segments has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°. The plurality of second electric sector segments each have a sector angle and the sum of the sector angles of the plurality of second electric sector segments is preferably 180°.

According to the preferred embodiment the second electric sector may comprise a semi-cylindrical electric sector comprising a first curved plate electrode and a second curved plate electrode. In a mode of operation the first curved plate electrode of the second electric sector is preferably maintained at an opposite polarity to the second curved plate electrode of the second electric sector.

In a mode of operation the first curved plate electrode of the second electric sector is preferably maintained at a potential selected from the group consisting of: (i) 0 V; (ii) 0-20 V; (iii) 20-40 V; (iv) 40-60 V; (v) 60-80 V; (vi) 80-100 V; (vii) 100-120 V; (viii) 120-140 V; (ix) 140-160 V; (x) 160-180 V; (xi) 180-200 V; (xii) 200-300 V; (xiii) 300-400 V; (xiv) 400-500 V; (xv) 500-600 V; (xvi) 600-700 V; (xvii) 700-800 V; (xviii) 800-900 V; (xix) 900-1000 V; (xx) 1-2 kV; (xxi) 2-3 kV; (xxii) 3-4 kV; (xxiii) 4-5 kV; and (xxiv) >5 kV. In a mode of operation the second curved plate electrode of the second electric sector is preferably maintained at a potential selected from the group consisting of: (i) 0 V; (ii) 0 to −20 V; (iii) −20 to −40 V; (iv) −40 to −60 V; (v) −60 to −80 V; (vi) −80 to −100 V; (vii) −100 to −120 V; (viii) −120 to −140 V; (ix) −140 to −160 V; (x) −160 to −180 V; (xi) −180 to −200 V; (xii) −200 to −300 V; (xiii) −300 to −400 V; (xiv) −400 to −500 V; (xv) −500 to −600 V; (xvi) −600 to −700 V; (xvii) −700 to −800 V; (xviii) −800 to −900 V; (xix) −900 to −1000 V; (xx) −1 to −2 kV; (xxi) −2 to −3 kV; (xxii) −3 to −4 kV; (xxiii) −4 to −5 kV; and (xxiv) <−5 kV.

The mass analyser preferably further comprises an ion outlet port provided in the second electric sector, wherein in use ions exit the mass analyser via the ion outlet port.

The second electric sector is preferably arranged to receive ions being transmitted in a third direction and is preferably arranged to eject ions in a fourth direction which is preferably opposite to the third direction. The first direction is preferably the same as the fourth direction. The second direction is preferably the same as the third direction.

According to the preferred embodiment in a first mode of operation ions enter the second electric sector at a first position and are rotated by 180° in an x-z plane and emerge at a second position. The ions which emerge from the second position of the second electric sector preferably subsequently enter the first electric sector at a first position and are rotated by 180° in a y-z plane and emerge at a second position. The ions which emerge from the second position of the first electric sector preferably subsequently enter the second electric sector at a third position and are rotated by 180° in an x-z plane and emerge at a fourth position. The ions which emerge from the fourth position of the second electric sector preferably subsequently enter the first electric sector at a third position and are rotated by 180° in a y-z plane and emerge at a fourth position. The ions which emerge from the fourth position of the first electric sector preferably subsequently pass to the first position of the second electric sector. The x-z plane is preferably orthogonal to the y-z plane.

According to another embodiment the mass analyser may comprise one or more further electric sectors. The mass analyser may, for example, comprise one, two, three, four, five, six, seven, eight, nine, ten or more than ten further electric sectors.

One or more of the further electric sectors may comprise a single electric sector. One or more of the further electric sectors may comprise a 180° electric sector.

According to an embodiment one or more of the further electric sectors may comprise a plurality of electric sector segments. The one or more further electric sectors may comprise two, three, four, five, six, seven, eight, nine, ten or more than ten further electric sector segments. One or more of the further electric sector segments preferably has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°.

The second electric sector and the one or more further electric sectors are preferably arranged in a staggered manner preferably opposite the first electric sector. The first electric sector is preferably substantially elongated.

According to an embodiment, in a first mode of operation ions preferably enter the first electric sector at a first position and are rotated by 180° in a y-z plane and emerge at a second position. The ions which emerge from the second position of the first electric sector preferably subsequently enter the second electric sector at a first position and are rotated by 180° in a x-z plane and emerge at a second position. The ions which emerge from the second electric sector at the second position preferably subsequently enter the first electric sector at a third position and are rotated by 180° in a y-z plane and emerge at a fourth position. The ions which emerge from the first electric sector at the fourth position preferably subsequently enter a third electric sector at a first position and are rotated by 180° in a x-z plane and emerge at a second position. The ions which emerge from the third electric sector at the second position preferably subsequently enter the first electric sector at a fifth position and are rotated by 180° in a y-z plane and emerge at a sixth position. The ions which emerge from the first electric sector at the sixth position subsequently enter a fourth electric sector at a first position and are rotated by 180° in a x-z plane and emerge at a second position. The ions which emerge from the fourth electric sector at the second position preferably subsequently enter the first electric sector at a seventh position and are rotated by 180° in an y-z plane and emerge at an eighth position. The ions which emerge from the first electric sector at the eighth position preferably subsequently enter a fifth electric sector at a first position and are rotated by 180° in a x-z plane and emerge at a second position. The ions which emerge from the fifth electric sector at the second position preferably subsequently enter the first electric sector at a ninth position and are rotated by 180° in a y-z plane and emerge at a tenth position. The ions which emerge from the first electric sector at the tenth position preferably subsequently enter a sixth electric sector at a first position and are rotated by 180° in a x-z plane and emerge at a second position. The ions which emerge from the sixth electric sector at the second position preferably subsequently enter the first electric sector at a eleventh position and are rotated by 180° in an y-z plane and emerge at a twelfth position. The x-z plane is preferably orthogonal to the y-z plane.

The mass analyser may further comprise one or more ion-optical devices for focusing ions in a first direction. The mass analyser may further comprise one or more ion-optical devices for focusing ions in a second direction which is preferably orthogonal to the first direction. The one or more ion-optical devices may comprise one or more quadrupole rod sets, one or more electrostatic lens arrangements or one or more Einzel lens arrangements.

The mass analyser preferably further comprises means for orthogonally extracting, orthogonally accelerating, orthogonally injecting or orthogonally ejecting ions into and/or out of the mass analyser.

The mass analyser may have a closed-loop geometry or an open-loop geometry.

According to an embodiment the mass analyser may further comprise one or more deflection electrodes for deflecting ions onto an ion detector. A pulsed voltage is preferably applied to the one or more deflection electrodes in order to deflect ions onto the ion detector.

The mass analyser preferably comprises an ion detector. The ion detector may comprise a microchannel plate ion detector.

The mass analyser may according to an embodiment comprise one or more detector plates wherein ions passing the one or more detector plates cause charge to be induced on to the one or more detector plates. The mass analyser may further comprise Fourier Transform analysis means for determining the time of flight of ions per cycle or orbit of the mass analyser.

The mass analyser preferably comprises a Time of Flight mass analyser or a Fourier Transform mass analyser.

According to another aspect of the present invention there is provided a mass spectrometer comprising a mass analyser as described above.

The mass spectrometer preferably further comprises an ion source. The ion source is preferably selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; and (xvi) a Nickel-63 radioactive ion source.

The ion source may comprise a continuous ion source. An ion gate and/or an ion trap and/or a pulsed deflector may be provided for providing a pulse of ions which is transmitted, in use, to the mass analyser. Alternatively, the ion source may comprise a pulsed ion source. The mass spectrometer preferably further comprises one or more mass filters arranged upstream of and/or within and/or downstream of the mass analyser. The one or more mass filters may be selected from the group consisting of: (i) a quadrupole rod set mass filter; (ii) a Time of Flight mass filter or mass spectrometer; (iii) a Wein filter; and (iv) a magnetic sector mass filter or mass spectrometer.

The mass spectrometer may further comprise one or more ion guides or ion traps arranged upstream of and/or within and/or downstream of the mass analyser.

According to an embodiment the mass spectrometer may further comprise means arranged and adapted to maintain at least a portion of the mass analyser at a pressure selected from the group consisting of: (i) $<10^{-7}$ mbar; (ii) $<10^{-6}$ mbar; (iii) $<10^{-5}$ mbar; (iv) $<10^{-4}$ mbar; (v) $<10^{-3}$ mbar; and (vi) $>10^{-3}$ mbar.

The mass spectrometer may further comprise a collision, fragmentation or reaction device arranged upstream of and/or within and/or downstream of the mass analyser. The collision, fragmentation or reaction device is preferably selected from the group consisting of: (i) a Surface Induced Dissociation ("SID") fragmentation device; (ii) an Electron Transfer Dissociation fragmentation device; (iii) an Electron Capture Dissociation fragmentation device; (iv) an Electron Collision or Impact Dissociation fragmentation device; (v) a Photo Induced Dissociation ("PID") fragmentation device; (vi) a Laser Induced Dissociation fragmentation device; (vii) an infrared radiation induced dissociation device; (viii) an ultraviolet radiation induced dissociation device; (ix) a nozzle-skimmer interface fragmentation device; (x) an in-source fragmentation device; (xi) an ion-source Collision Induced Dissociation fragmentation device; (xii) a thermal or temperature source fragmentation device; (xiii) an electric field induced fragmentation device; (xiv) a magnetic field induced fragmentation device; (xv) an enzyme digestion or enzyme degradation fragmentation device; (xvi) an ion-ion reaction fragmentation device; (xvii) an ion-molecule reaction fragmentation device; (xviii) an ion-atom reaction fragmentation device; (xix) an ion-metastable ion reaction fragmentation device; (xx) an ion-metastable molecule reaction fragmentation device; (xxi) an ion-metastable atom reaction fragmentation device; (xxii) an ion-ion reaction device for reacting ions to form adduct or product ions; (xxiii) an ion-molecule reaction device for reacting ions to form adduct or product ions; (xxiv) an ion-atom reaction device for reacting ions to form adduct or product ions; (xxv) an ion-metastable ion reaction device for reacting ions to form adduct or product ions; (xxvi) an ion-metastable molecule reaction device for reacting ions to form adduct or product ions; (xxvii) an ion-metastable atom reaction device for reacting ions to form adduct or product ions; and (xxviii) a Collision Induced Dissociation ("CID") fragmentation device.

According to another aspect of the present invention there is provided a method of mass analysing ions comprising:

passing ions to a first electric sector; and then passing ions to a second electric sector, wherein the second electric sector is arranged orthogonal to the first electric sector.

According to an aspect of the present invention there is provided a closed-loop mass analyser, comprising:

a first electric sector; and a second electric sector, wherein the second electric sector is arranged orthogonal to the first electric sector;

wherein in a mode of operation ions perform one or more cycles or orbits of the mass analyser, and wherein during one cycle or orbit of the mass analyser ions:

(i) enter the second electric sector at a first position and are rotated by 180° in an x-z plane and emerge at a second position; and then (ii) pass through a field free region; and then (iii) enter the first electric sector at a first position and are rotated by 180° in a y-z plane and emerge at a second position; and then (iv) pass through a field free region; and then (v) enter the second electric sector at a third position and are rotated by 180° in an x-z plane and emerge at a fourth position; and then (vi) pass through a field free region; and then (vii) enter the first electric sector at a third position and are rotated by 180° in a y-z plane and emerge at a fourth position; and then (viii) pass through a field free-region;

wherein the x-z plane is orthogonal to the y-z plane.

According to an aspect of the present invention there is provided a method of mass analysing ions, comprising:

providing a closed-loop mass analyser comprising a first electric sector and a second electric sector, wherein the second electric sector is arranged orthogonal to the first electric sector; and causing ions to perform one or more cycles or orbits of the mass analyser, wherein during one cycle or orbit of the mass analyser ions:

(i) enter the second electric sector at a first position and are rotated by 180° in an x-z plane and emerge at a second position; and then (ii) pass through a field free region; and then (iii) enter the first electric sector at a first position and are rotated by 180° in a y-z plane and emerge at a second position; and then (iv) pass through a field free region; and then (v) enter the second electric sector at a third position and are rotated by 180° in an x-z plane and emerge at a fourth position; and then (vi) pass through a field free region; and then (vii) enter the first electric sector at a third position and are rotated by 180° in a y-z plane and emerge at a fourth position; and then (viii) pass through a field free region;

wherein the x-z plane is orthogonal to the y-z plane.

According to an aspect of the present invention there is provided an open-loop mass analyser, comprising:

an elongated first electric sector;

a second electric sector; and a third electric sector, wherein the second and third electric sectors are arranged orthogonal to the first electric sector;

wherein in a mode of operation ions:

(i) enter the first electric sector at a first position and are rotated by 180° in a y-z plane and emerge at a second position; and then (ii) pass through a field free region; and then (iii) enter the second electric sector at a first position and are rotated by 180° in a x-z plane and emerge at a second position; and then (iv) pass through a field free region; and then (v) enter the first electric sector at a third position and are rotated by 180° in a y-z plane and emerge at a fourth position; and then (vi) pass through a field free region; and then (vii) enter the third electric sector at a first position and are rotated by 180° in a x-z plane and emerge at a second position;

wherein the x-z plane is orthogonal to the y-z plane.

According to an aspect of the present invention there is provided a method of mass analysing ions comprising:

providing an open-loop mass analyser, comprising an elongated first electric sector, a second electric sector and a third electric sector, wherein the second and third electric sectors are arranged orthogonal to the first electric sector; and causing ions to:

(i) enter the first electric sector at a first position and be rotated by 180° in a y-z plane and emerge at a second position; and then (ii) pass through a field free region; and then (iii) enter the second electric sector at a first position and be rotated by 180° in a x-z plane and emerge at a second position; and then (iv) pass through a field free region; and then (v) enter the first electric sector at a third position and be rotated by 180° in a y-z plane and emerge at a fourth position; and then (vi) pass through a field free region; and then (vii) enter the third electric sector at a first position and be rotated by 180° in a x-z plane and emerge at a second position;

wherein the x-z plane is orthogonal to the y-z plane.

According to an aspect of the present invention there is provided a multi-turn Time of Flight mass analyser comprising:

a first electric sector;

a second electric sector, wherein the second electric sector is arranged orthogonal to the first electric sector; and ion detection means selected from the group consisting of: (i) one or more deflection electrodes for deflecting ions onto an ion detector; and (ii) one or more detector plates wherein ions passing the one or more detector plates cause charge to be induced on to the one or more detector plates and wherein the ion detection means further comprises Fourier Transform analysis means for determining the time of flight of ions per cycle or orbit of the mass analyser.

According to an aspect of the present invention there is provided a method of mass analysing ions comprising:

providing a multi-turn Time of Flight mass analyser comprising a first electric sector and a second electric sector, wherein the second electric sector is arranged orthogonal to the first electric sector; and detecting ions either by: (i) providing one or more deflection electrodes which deflect ions onto an ion detector; or (ii) providing one or more detector plates wherein ions passing the one or more detector plates cause charge to be induced on to the one or more detector plates and wherein the method further comprises Fourier Transform analysis to determine the time of flight of ions per cycle or orbit of the mass analyser.

According to another aspect of the present invention there is provided a mass analyser comprising:

a first electric sector comprising a plurality of first electric sector segments wherein each first electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and a second electric sector comprising a plurality of second electric sector segments wherein each second electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and wherein the second electric sector segments are arranged orthogonal to the first electric sector segments.

According to another aspect of the present invention there is provided a method of mass analysing ions comprising:

passing ions to a first electric sector comprising a plurality of first electric sector segments wherein each first electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and passing ions to a second electric sector comprising a plurality of second electric sector segments wherein each second electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and wherein the second electric sector segments are arranged orthogonal to the first electric sector segments.

According to another aspect there is provided a closed-loop Time of Flight or Fourier Transform mass analyser wherein ions are transmitted, in use, in a first plane and in a second plane which is orthogonal to the first plane.

According to another aspect there is provided an open-loop Time of Flight or Fourier Transform mass analyser wherein ions are transmitted, in use, in a first plane and in a second plane which is orthogonal to the first plane.

According to another aspect there is provided a method of mass analysing ions comprising:

providing a closed-loop Time of Flight or Fourier Transform mass analyser; and transmitting ions in a first plane and in a second plane which is orthogonal to the first plane.

According to another aspect there is provided a method of mass analysing ions comprising:

providing an open-loop Time of Flight or Fourier Transform mass analyser; and transmitting ions in a first plane and in a second plane which is orthogonal to the first plane.

According to another aspect there is provided a Time of Flight or Fourier Transform mass analyser comprising:

a first electric sector comprising one or more first electric sector segments wherein each first electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°;

a second electric sector comprising one or more second electric sector segments wherein each second electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and a third electric sector comprising one or more third electric sector segments wherein each third electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°;

wherein the one or more second electric sector segments are arranged orthogonal to the one or more first electric sector segments and wherein the one or more third electric sector segments are arranged orthogonal to either the one or more first electric sector segments or the one or more second electric sector segments.

According to another aspect there is provided a method of mass analysing ions comprising:

providing a Time of Flight or Fourier Transform mass analyser;

passing ions to a first electric sector comprising one or more first electric sector segments wherein each first electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°;

passing ions to a second electric sector comprising one or more second electric sector segments wherein each second electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°; and passing ions to a third electric sector comprising one or more third electric sector segments wherein each third electric sector segment has a sector angle selected from the group consisting of: (i) 0°-10°; (ii) 10°-20°; (iii) 20°-30°; (iv) 30°-40°; (v) 40°-50°; (vi) 50°-60°; (vii) 60°-70°; (viii) 70°-80°; (ix) 80°-90°; (x) 90°-100°; (xi) 100°-110°; (xii) 110°-120°; (xiii) 120°-130°; (xiv) 130°-140°; (xv) 140°-150°; (xvi) 150°-160°; (xvii) 160°-170°; and (xviii) 170°-180°;

wherein the one or more second electric sector segments are arranged orthogonal to the one or more first electric sector segments and wherein the one or more third electric sector segments are arranged orthogonal to either the one or more first electric sector segments or the one or more second electric sector segments.

Various embodiments of the present invention will now be described, by way of example only, and with reference to the accompanying drawings in which.

Figure 1:
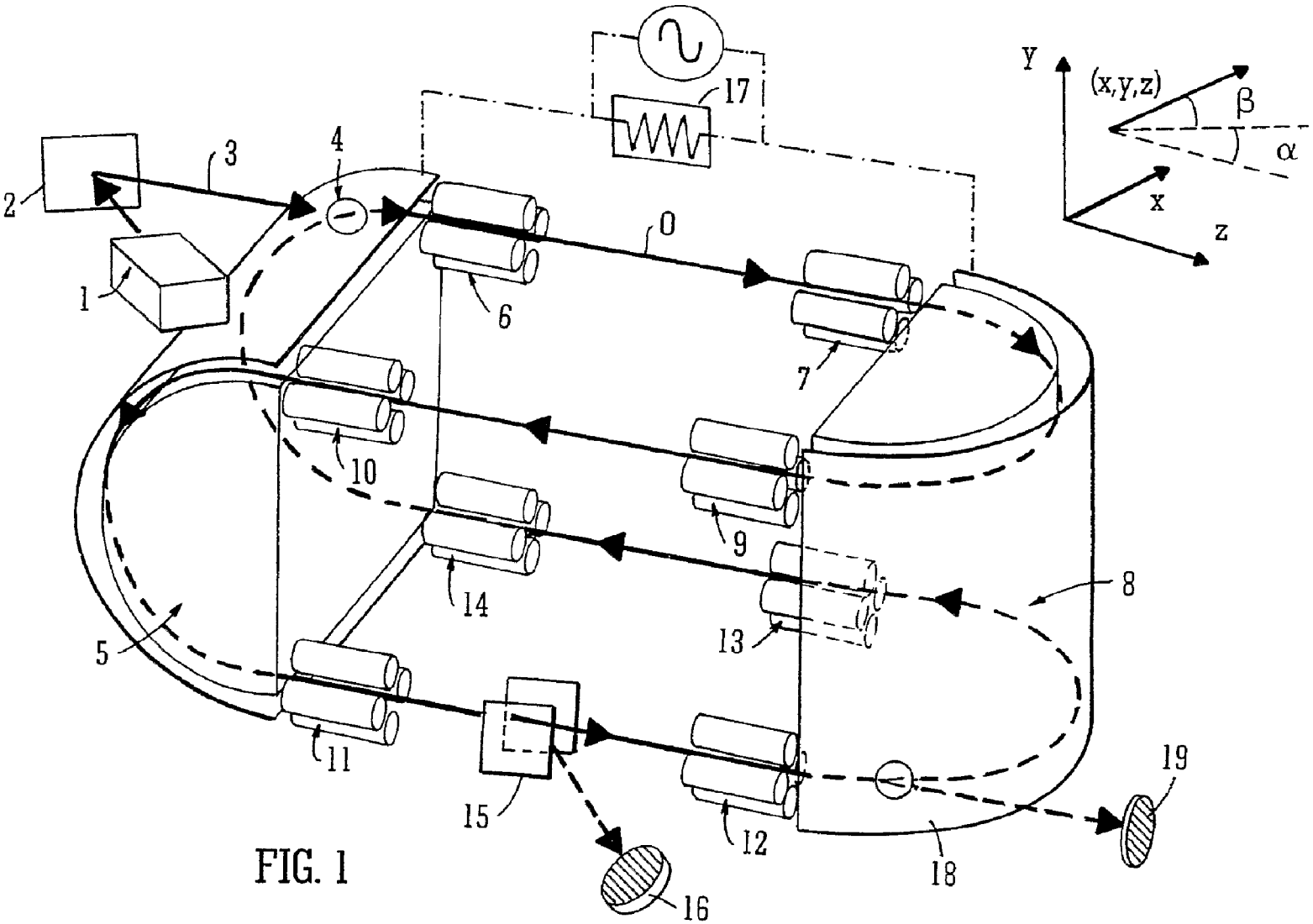
FIG. 1 shows a multi-turn Time of Flight mass analyser having a closed loop geometry according to an embodiment of the present invention.

The concept of perfect focusing in a multi-turn Time of Flight mass analyser will now be discussed in more detail whilst considering a preferred embodiment of the present invention as shown in FIG. 1. The concept of perfect focussing can best be illustrated by considering a transfer matrix for a complete multi-turn Time of Flight mass analyser. A coordinate system (x,y,z) may be defined with its origin O on the optical axis and with the z direction along the initial curvilinear optical axis as shown in FIG. 1. The geometric trajectory of an ion of constant mass can be expressed by a position vector (x, α, y, β, δ) wherein x, y, α, β denote the lateral and angular deviations of an ion under consideration relative to a reference ion. The energy deviation relative to the reference ion may be defined by:

$$U/q=(U_0/q_0)(1+\delta) \tag{2}$$

wherein U/q and $U_0/q_0$ are the ratios of the kinetic energy to charge of the arbitrary ion of interest and the reference ion respectively. By definition, the reference ion has zero initial vector conditions.

In order to determine flight time spread, the concept of path length deviation L is included in the position vector. The final position vector is related to the initial position vector by a first order transfer matrix as shown below:

$$\begin{bmatrix} x \\ \alpha \\ y \\ \beta \\ \delta \\ L \end{bmatrix} = \begin{bmatrix} \langle x|x\rangle & \langle x|\alpha\rangle & 0 & 0 & \langle x|\delta\rangle & 0 \\ \langle \alpha|x\rangle & \langle \alpha|\alpha\rangle & 0 & 0 & \langle \alpha|\delta\rangle & 0 \\ 0 & 0 & \langle y|y\rangle & \langle y|\beta\rangle & \langle y|\delta\rangle & 0 \\ 0 & 0 & \langle \beta|y\rangle & \langle \beta|\beta\rangle & \langle \beta|\delta\rangle & 0 \\ 0 & 0 & 0 & 0 & 1 & 0 \\ \langle L|x\rangle & \langle L|\alpha\rangle & \langle L|y\rangle & \langle L|\alpha\rangle & \langle L|\delta\rangle & 1 \end{bmatrix} \begin{bmatrix} x_0 \\ \alpha_0 \\ y_0 \\ \beta_0 \\ \delta_0 \\ L_0 \end{bmatrix} \tag{3}$$

In order to calculate Δt, L should be divided by the velocity of the reference ion.

A transfer matrix for each optical component or portion of the mass analyser can be calculated numerically to first order when its parameters are known. The full system may comprise several ion optical components, such as electric sectors, quadrupole lenses (or Einzel lenses) and field free drift spaces. The total transfer matrix can be determined by multiplying the matrices corresponding to each individual ion optical component.

In order to preserve the dimensions of the ion packet, $\langle x|x\rangle$, $\langle y|y\rangle$, $\langle \alpha|\alpha\rangle$ and $\langle \beta|\beta\rangle$ should be either±unity. In order to preserve angular focusing in x and y, $\langle x|\alpha\rangle$ and $\langle x|\beta\rangle$ should be zero. Furthermore, $\langle x|\delta\rangle$ and $\langle y|\delta\rangle$ should be zero in order to maintain lateral dimensions. Also $\langle \alpha|x\rangle$, $\langle \alpha|\delta\rangle$, $\langle \beta|y\rangle$ and $\langle \beta|\delta\rangle$ should be zero in order to maintain the absolute value of the angular deviations.

For a Time of Flight mass analyser, the path length deviation should not increase. Hence, in order to minimise Δt:

$$\langle L|x\rangle=\langle L|\alpha\rangle=\langle L|y\rangle=\langle L|\alpha\rangle=\langle L|\delta\rangle=0 \tag{4}$$

Therefore, 17 matrix elements of the total transfer matrix as detailed above should be arranged so as to meet the above required conditions. This may be achieved by searching for numerical solutions to various geometries in which the above focusing conditions are met using the Simplex method.

According to the preferred embodiment a Time of Flight mass analyser having a very long effective flight path but also having a compact geometry and a relatively small size is provided by arranging two 180° cylindrical electric sectors 5,8 orthogonally to each other as shown in FIG. 1. Advantageously, focusing in the x direction is achieved using identical ion optical components to those used to achieve focusing in the y direction. The preferred embodiment advantageously avoids the need to use Matsuda plates or complex toroidal components in order to achieve focusing.

The symmetry of focusing according to the preferred embodiment simplifies the design of the overall mass analyser as it is only necessary to solve the perfect focusing conditions in either the x or the y plane. Optional additional focusing elements such as quadrupole rod sets 6,7, 9-14 or Einzel lenses may be positioned between the electric sectors 5,8 in order to achieve perfect focussing conditions to a second or higher order.

According to an embodiment ions may be detected by an ion detector (not shown) comprising one or more electrode plates. The one or more electrode plates are preferably arranged adjacent the flight path of ions. As ions fly past the one or more electrode plates charge is preferably induced on the one or more electrode plates. The resulting voltage signal is then preferably recorded in the time domain. The voltage signal is then preferably converted from the time domain into the frequency domain. However, unlike a FT-ICR instrument, the ion detector does not measure the cyclotron frequency. Instead, the ion detector measures the time of flight per cycle or orbit of the mass analyser. The measured time of flight per cycle or orbit of the mass analyser is proportional to $1/\sqrt{m}$. By Fourier analysis of the raw time data, a mass and abundance spectrum may be generated. According to this embodiment it is not a problem if ions having relatively low mass to charge ratios overtake and lap ions having relatively high mass to charge ratios since the mass to charge ratio of the ions can be determined from the time of flight per cycle or orbit of the ions.

The mass analyser preferably comprises two identical 180° electric sectors 5,8. The electric sectors 5,8 are preferably arranged orthogonally to each another so that ions are preferably focused (in angle and position) in the y and x directions respectively. Ions are preferably arranged to fly on a mean radius of 183 mm through the first and second electric sectors 5,8. In addition, further higher-order focusing in the x direction (and corresponding defocusing in the y direction) may optionally be achieved using four preferably identical quadrupole rod sets 6,10,11,14 which are preferably arranged in close proximity to the first electric sector 5. Similarly, higher-order focusing in the y direction (and corresponding defocusing in the x direction) may optionally be achieved using four preferably identical quadrupole rod sets 7,9,12,13 which are preferably arranged in close proximity to the second electric sector 8. All eight quadrupole rod sets 6,7,9-14 are preferably identical and each quadrupole rod set preferably comprises four identical rods. The four quadrupole rod sets 6,10,11,14 that focus ions in the x direction are preferably rotated through 180° relative to the four quadrupole rod sets 7,9,12,13 that preferably focus ions in the y direction.

According to the preferred embodiment the mass spectrometer may comprise a Matrix Assisted Laser Desorption Ionisation ("MALDI") ion source which preferably comprises a laser 1 and a MALDI sample or target plate 2. A laser beam from the laser 1 is preferably directed on to the MALDI sample or target plate 2 in order to ionise a sample. A resulting pulse of ions is preferably accelerated away from the sample or target plate 2 towards the mass analyser. The ions are preferably accelerated so that they possess a kinetic energy of 715 eV. The ions are then preferably injected into the mass analyser by passing through a small screened hole 4 in the outer electrode of the first electric sector 5 whilst both electrodes of the first electric sector 5 are preferably held at ground potential. When all of the ions of interest have entered the mass analyser, a voltage of +100 V is then preferably applied to the outer electrode of the first electric sector 5 and a voltage of −100 V is preferably applied to the inner electrode of the first electric sector 5. Meanwhile, the outer electrode of the second electric sector 8 is preferably maintained at a constant voltage of +100 V and the inner electrode of the second electric sector 8 is preferably maintained at a constant voltage of −100 V. The ions which are injected into the mass analyser preferably pass through a quadrupole rod set 6 and then travel through a field free region.

In order to illustrate the principle of operation of the preferred mass analyser ions can be considered as starting from a virtual origin O which is preferably located at a point midway between the two electric sectors 5,8 in the middle of a field free region downstream of the hole or ion inlet port 4. The ions preferably continue to move from the origin O towards the second electric sector 8 and pass through a field free region having a length FFR/2. The ions then preferably pass through a quadrupole rod set 7 having a length LQ which preferably focuses the ions in the y plane (with a corresponding defocusing action in the x plane). The ions then preferably pass through a short field free region having a length FFRq before entering the second electric sector 8. Ions preferably enter the second electric sector 8 and are preferably focused in the x plane.

Ions preferably travel around the second electric sector 8 and then preferably pass through a further short field free region having a length FFRq. The ions are then preferably focused in the y plane by a quadrupole rod set 9. The quadrupole rod set 9 preferably has a length LQ. The ions then preferably pass through a field free region having a length FFR until the ions reach a quadrupole rod set 10 which preferably focuses the ions in the x plane. The ions preferably pass through the quadrupole rod set 10 which preferably has a length LQ and then preferably pass through a short field free region which preferably has a length FFRq. The ions then preferably enter the first electric sector 5 and are preferably focused in the y plane.

Ions preferably travel around the first electric sector 5 and then preferably pass through a short field free region having a length FFRq. The ions are then preferably focused in the x plane by a quadrupole rod set 11. The quadrupole rod set 11 preferably has a length LQ. The ions then preferably pass through a field free region having a length, FFR until the ions reach a quadrupole rod set 12 which preferably focuses the ions in the y plane. The ions preferably pass through the quadrupole rod set 12 which preferably has a length LQ and then preferably pass through a short field free region which preferably has a length FFRq. The ions then preferably enter the second electric sector 8 and are preferably focused in the x plane.

Ions preferably travel around the second electric sector 8 and then preferably pass through a short field free region having a length FFRq. The ions are then preferably focused in the y plane by a quadrupole rod set 13. The quadrupole rod set 13 preferably has a length LQ. The ions then preferably pass through a field free region having a length FFR until the ions reach a quadrupole rod set 14 which preferably focuses the ions in the x plane. The ions preferably pass through the quadrupole rod set 14 which preferably has a length LQ and then preferably pass through a short field free region which preferably has a length FFRq. The ions then preferably enter the first electric sector 5 and are preferably focused in the y plane.

Ions preferably travel around the first electric sector 5 and then preferably pass through a short field free region having a length FFRq. The ions are then preferably focused in the x plane by a quadrupole rod set 6. The quadrupole rod set 6 preferably has a length LQ. The ions then preferably pass through a field free region having a length FFR/2 until the ions return to the origin O. When the ions reach the origin O they will have made are complete circuit of the mass analyser. All the quadrupole rod sets 6,7,9-14 which are preferably located within the mass analyser preferably have substantially the same voltages applied to them and preferably have substantially the same dimensions.

According to the preferred embodiment a voltage of ±36.57 V is preferably applied to opposing pairs of rods of all of the quadrupole rod sets 6,7,9-14. The quadrupole rod sets 6,7,9-14 preferably each comprise four rods. Each rod is preferably 20 mm long. The inscribed radius of the rods is preferably 15 mm. The relatively long field free region FFR between two quadrupole rod sets is preferably 780 mm and the relatively short field free region FFRq between a quadrupole rod set 6; 7; 9-14 and an electric sector 5; 8 is preferably 2.6 mm.

According to the preferred embodiment after half a circuit, ions will preferably be refocused. However, the image will be inverted and hence perfect focusing as described above will not be achieved. After one complete circuit of the mass analyser the values of the elements in the total transfer matrix are calculated as follows:

$$\begin{bmatrix} x \\ \alpha \\ y \\ \beta \\ \delta \\ L \end{bmatrix} = \begin{bmatrix} 1.00 & 0.00 & 0.00 & 0.00 & 0.00 & 0.00 \\ 0.00 & 1.00 & 0.00 & 0.00 & 0.00 & 0.00 \\ 0.00 & 0.00 & 1.00 & 0.00 & 0.00 & 0.00 \\ 0.00 & 0.00 & 0.00 & 1.00 & 0.00 & 0.00 \\ 0.00 & 0.00 & 0.00 & 0.00 & 1.00 & 0.00 \\ 0.00 & 0.00 & 0.00 & 0.00 & 0.00 & 1.00 \end{bmatrix} \begin{bmatrix} x_0 \\ \alpha_0 \\ y_0 \\ \beta_0 \\ \delta_0 \\ L_0 \end{bmatrix} \quad (5)$$

It can therefore be seen that the mass analyser according to the preferred embodiment achieves perfect focusing to at least a first order approximation. The quadrupole rod sets 6,7,9-14 preferably ensure that perfect focussing to second and higher orders is achieved.

The total path length of one circuit of the preferred mass analyser is preferably 5.597 m and for ions having a mass to charge ratio of 1000 the total $\Delta t$ aberration to first order resulting from the multi-turn Time of Flight mass analyser is less than 1 ps for input conditions where $x_0$=1 mm, $\alpha_0$=1 mrad, $y_0$=1 mm, $\beta_0$=1 mrad, $\delta_0$=0.01 and $L_0$=0.

According to an embodiment ions may be detected by diverting the ions from their orbit around the mass analyser and then directing the ions on to an ion detector 16. According to this embodiment a pair of deflection plates 15 are preferably provided which are preferably arranged across or adjacent the ion path. A DC voltage is preferably applied to the pair of deflection plates 15 after a programmable time delay. The ions which are preferably deflected from their orbits are preferably detected by a pair of micro-channel plates 16 which preferably form an ion detector 16.

If ions are allowed to complete multiple circuits of the mass analyser then it will become harder to assign masses to the spectral data recorded since ions having relatively low mass to charge ratios may have lapped ions having relatively high mass to charge ratios a number of times. In order to assign masses to the spectra it is necessary to know the exact number of turns or circuits that ions having a particular mass to charge ratio have completed when the voltage pulse is applied to the deflection plates 15. By keeping the number of cycles relatively low the process of peak assignment is not particularly problematic. However, for greater numbers of cycles with complex spectra, peak assignment can be achieved by acquiring multiple spectra after different programmable delay times. By correlating peaks within the different spectra and applying a suitable calibration algorithm, the exact number of turns for correlated peaks can be calculated thereby allowing confident mass assignment.

According to this embodiment multiple sets of data are therefore acquired at different times and the mass to charge ratio(s) of ions which may be present at the position between the deflection plates 15 when a DC voltage is applied may be determined for each set of data. It is then possible to analyse the multiple sets of data and to deduce the mass to charge ratios of ions observed in the sets of data.

According to another embodiment the voltages applied to one of the electric sectors, in this case the second electric sector 8, may be switched OFF in order to allow ions to stream out through a hole or ion outlet port 18 provided in the outer electrode of the electric sector in question. The ions may then be detected by an ion detector such as an microchannel plate ion detector 19. Again, multiple spectra may be acquired after different delay times. Peaks within different spectra may be correlated using a suitable calibration algorithm and mass to charge ratios can be assigned to peaks.

Additionally and/or alternatively ions may be detected by measuring the voltage signal caused by the induced electrostatic charge on a detector plate as ions fly past the detector plate. According to an embodiment the voltage difference generated between the first electric sector 5 and the second electric sector 8 may be used. The charge which flows through a high impedance resistor 17 will provide a voltage signal which can be measured. The voltage signal may then be subjected to Fourier transform analysis and a frequency spectrum may be generated. The time of flight per cycle or orbit which is proportional to $1/\sqrt{m}$ may be measured and a mass spectrum may then be generated.

An alternative method of injecting ions into the mass analyser will now be described with reference to FIG. 2. According to this embodiment ions from an ion beam 20 are preferably orthogonally accelerated into the path of the preferred mass analyser using an ion injection device 21. The ion injection device 21 preferably comprises a pair of electrode plates with associated acceleration and focusing optics. The electrode plates are preferably arranged in a plane which is orthogonal to an ion path through the mass analyser. Once ions are orthogonally injected into the mass analyser the voltages applied to the ion injection device 21 are then preferably set back to ground. The electrode plates and acceleration optics preferably have 100% transmission apertures (rather than grids) so as to allow an ion beam to pass substantially unhindered through the ion injection device 21.

Figure 3:
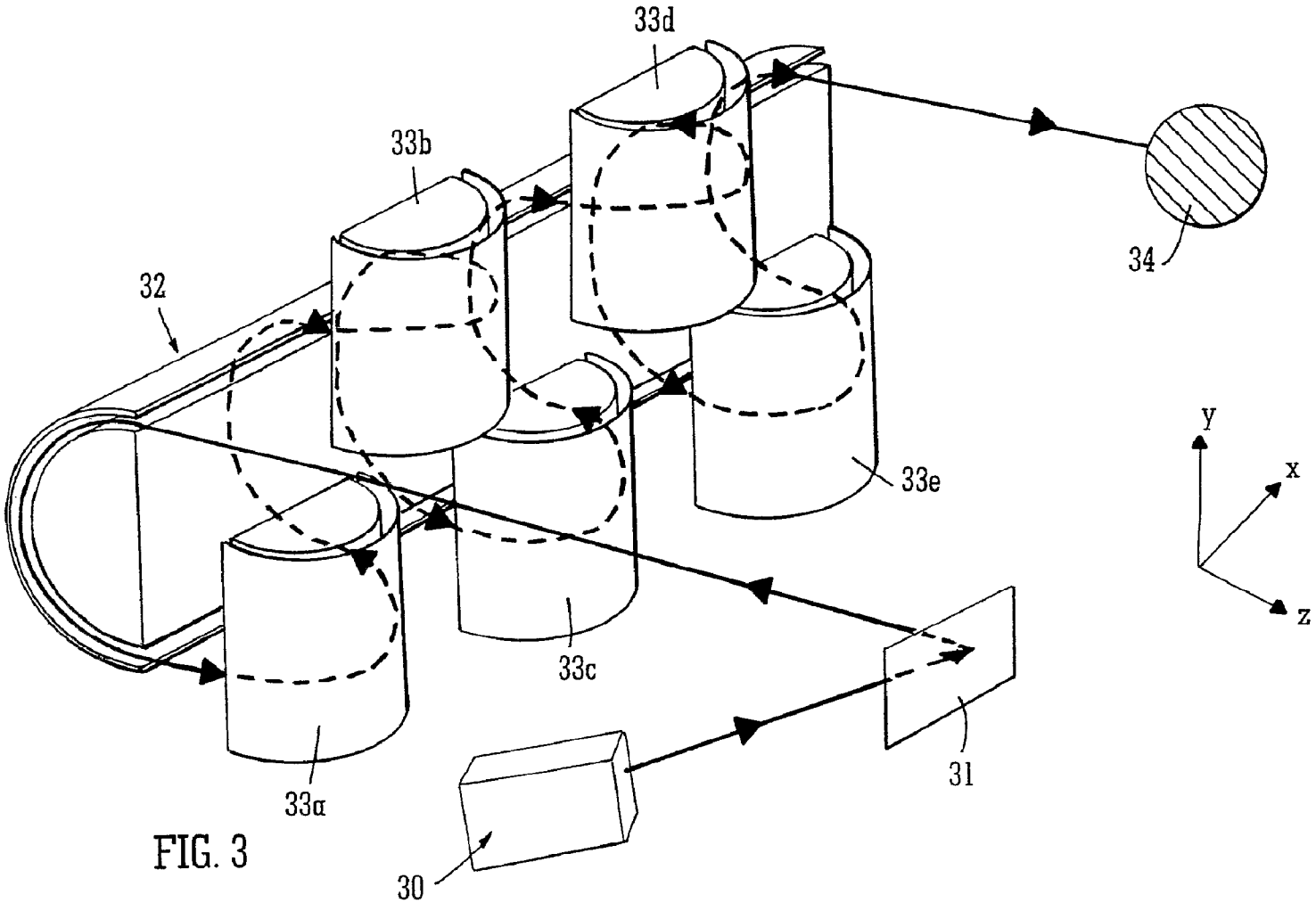
FIG. 3 shows a multi-turn Time of Flight mass analyser according to further embodiment wherein the mass analyser has an open loop geometry.

A mass analyser according to another embodiment of the present invention is shown in FIG. 3. According to this embodiment the mass analyser has an open loop geometry rather than a closed loop geometry. The mass analyser preferably comprises a first elongated electric sector 32 and a plurality of other smaller electric sectors 33*a*-33*e*. The smaller electric sectors 33*a*-33*e* are preferably arranged in an orthogonal and staggered manner relative to the first elongated electric sector 32. An ion detector 34 is preferably provided downstream of the electric sectors 32,33*a*-33*e*. The ion detector 34 preferably comprises a microchannel plate detector 34. An ion source is preferably provided which preferably comprises a MALDI ion source 30. The ion source 30 preferably comprises a laser which preferably outputs a pulsed laser beam. The pulsed laser beam is preferably targeted onto a MALDI sample or target plate 31. Ions are preferably desorbed from the surface of the MALDI sample or target plate 31 and are preferably accelerated towards the first elongated electric sector 32.

The ions are preferably received by the first elongated electric sector 32 are and then preferably passed around the first elongated electric sector 32 and are preferably focussed in the y direction. The ions are then preferably transmitted to a second electric sector 33*a*.

The ions preferably travel around the second electric sector 33*a* and are preferably focussed in the x direction. The ions are then preferably transmitted back to the first elongated electric sector 32. The ions preferably travel around the first elongated electric sector 32 and are preferably focussed in the y direction. The ions are then preferably transmitted to a third electric sector 33*b*.

The ions preferably travel around the third electric sector 33*b* and are preferably focussed in the x direction. The ions are then preferably transmitted back to the first elongated electric sector 32. The ions preferably travel around the first elongated electric sector 32 and are preferably focussed in the y direction. The ions are then preferably transmitted to a fourth electric sector 33*c*.

The ions preferably travel around the fourth electric sector 33*c* and are preferably focussed in the x direction. The ions are then preferably transmitted back to the first elongated electric sector 32. The ions preferably travel around the first elongated electric sector 32 and are preferably focussed in the y direction. The ions are then preferably transmitted to a fifth electric sector 33*d*.

The ions preferably travel around the fifth electric sector 33*d* and are preferably focussed in the x direction. The ions are then preferably transmitted back to the first elongated electric sector 32. The ions preferably travel around the first elongated electric sector 32 and are preferably focussed in the y direction. The ions are then preferably transmitted to a sixth electric sector 33*e*.

The ions preferably travel around the sixth electric sector 33*e* and are preferably focussed in the x direction. The ions are then preferably transmitted back to the first elongated electric sector 32. The ions preferably travel around the first elongated electric sector 32 and are preferably focussed in the y direction. The ions are then preferably transmitted to the ion detector 34.

The second, third, fourth, fifth and six electric sectors 33*a*,33*b*,33*c*,33*d*,33*e* are preferably positioned in a staggered manner opposite and along the length of the first elongated electric sector 32. The second, third, fourth, fifth and sixth electric sectors 33*a*,33*b*,33*c*,33*d*,33*e* preferably effectively pass ions backwards and forwards along and between the first elongated electric sector 32 and the other electric sectors 33*a*-33*e*.

Additional focusing means (not shown) for higher order focusing of the ions in either the x plane and/or the y plane may optionally be provided just before and/or just after the entry and exit positions of ions into or from the first electric sector 32 and/or the other electric sectors 33*a*-33*e*. The focusing means may comprise a quadrupole rod set or an Einzel lens arrangement. The combined transfer matrix for the electric sectors 32,33*a*-33*e*, the field free regions and any additional focussing elements may be arranged so as to achieve perfect focusing conditions.

According to an embodiment the path length of the multi-pass Time of Flight mass analyser as shown in FIG. 3 may be greater than 13 m. The electric sectors 32,33*a*-33*e* may, according to an embodiment, have a radius of 183 mm. Advantageously, although the mass analyser may have a very long ion flight path, the mass analyser is nonetheless relatively compact since it has a folded geometry and preferably occupies a relative small volume.

According to the various embodiments discussed above a high mass resolution mass analyser is preferably provided which preferably exhibits minimal losses in ion transmission. The mass analyser may have a closed-loop geometry as shown in FIGS. 1 and 2 in which case the issue of ions lapping one another may be solved either by determining the time of flight per cycle or orbit of the mass analyser or by acquiring multiple data sets at different times and determining the mass to charge ratios of ions which could be present at the detection region when the various data set were acquired. Alternatively, the mass analyser may comprise an open-loop geometry as shown in FIG. 3 wherein ions do not lap each other. According to several of the embodiments described above a relatively inexpensive MCP ion detector may advantageously be used in order to detect ions.

Figure 2:
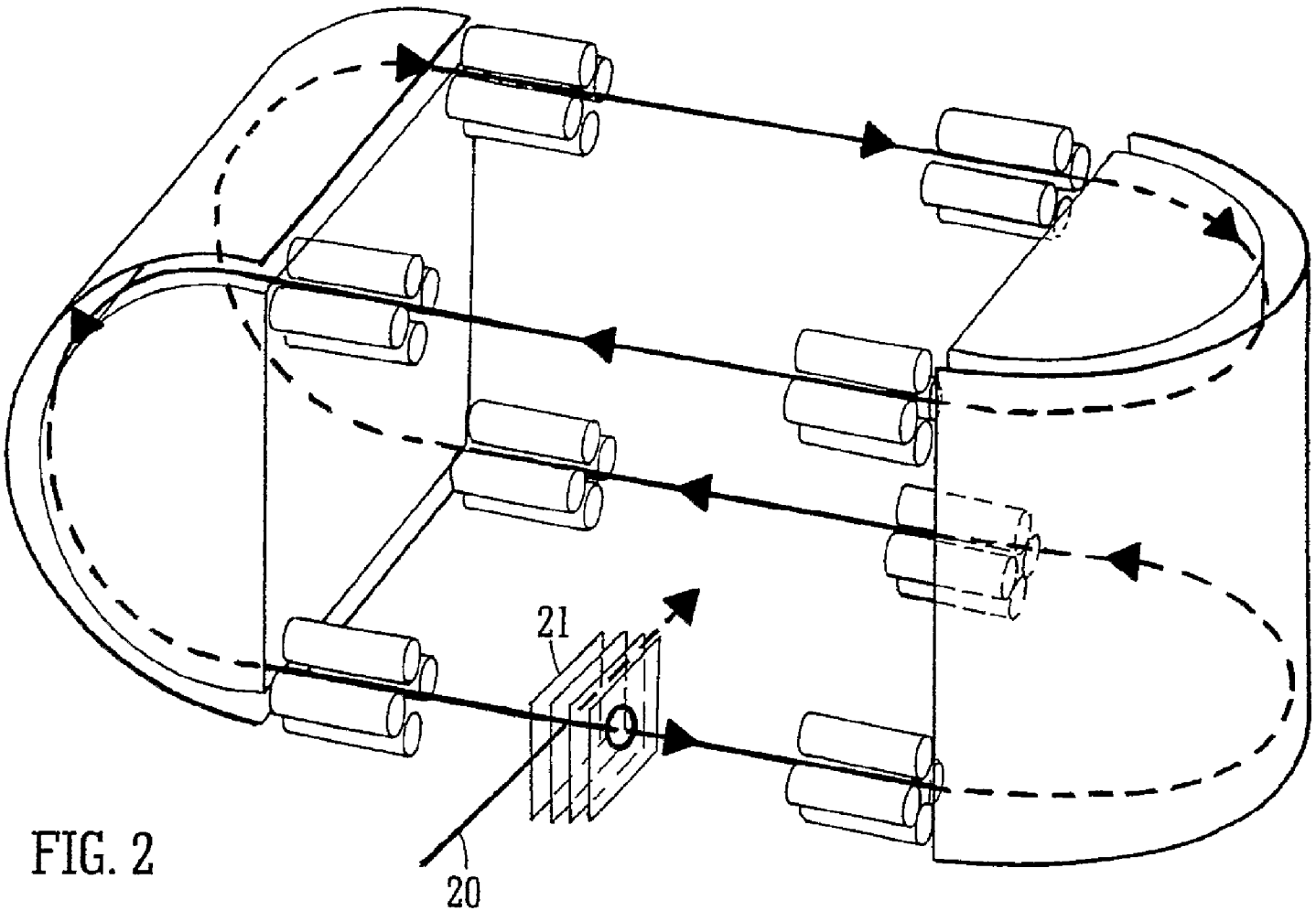
FIG. 2 shows a multi-turn Time of Flight mass analyser according to an embodiment of the present invention wherein ions are orthogonally accelerated into the mass analyser.

Further embodiments are contemplated wherein one or more of the 180° electric sectors described above in relation to the embodiments shown in FIGS. 1-3 are sub-divided into two or more smaller electric sector segments with a relatively short drift region between the electric sector segments.

Ions passing through a cylindrical electric sector experience focusing in the radial direction, i.e. in the plane in which the ions are deflected or dispersed (e.g. y). The ions do not experience focusing in the direction normal to the plane in which they are deflected or dispersed, i.e. in the direction parallel to the axis of curvature (e.g. z) of the cylindrical electric sector.

If the sector angle of a cylindrical electric sector is $\Phi_e$ then the focusing properties of the electric sector in the y-direction are given by Newton's thick lens formula:

$$(l_e'-g_e)(l_e''-g_e)=f_e^2 \tag{6}$$

wherein:

$$g_e=r_e/\sqrt{2}\cdot\tan(\sqrt{2}\cdot\Phi_e) \tag{7}$$

$$f_e=r_e/\sqrt{2}\cdot\sin(\sqrt{2}\cdot\Phi_e) \tag{8}$$

wherein $r_e$ is the radius of curvature of the ion trajectory, $l_e'$ is the object length (distance from the source of ions to the entrance to the electric sector) and $l_e''$ is the image length (distance from the exit of the electric sector to the focused image of the source of ions).

For stigmatic focusing of the ion beam, regardless of how many circuits of the two orthogonal electric sectors the ions complete, there are two requirements. Firstly, the complete path length in one complete circuit comprising two 180° arcs through two electric sectors and four field free regions (d) between the two electric sectors should correspond with a distance equal to that in which: (i) ions formed in a line in the y-direction at some point in the circuit are re-focussed to a line in the y-direction as the ions arrive at the same point in the next circuit; and (ii) ions formed in a line in the x-direction at some point in the circuit are re-focussed to a line in the x-direction as the ions arrive at the same point in the next circuit. Secondly, the focussing characteristics of each electric sector should be such that the re-focused lines in the y-direction and x-direction each have unity magnification.

As a consequence of these requirements the sum of the object distance $l_e'$ and the image distance $l_e''$ for one electric sector should equal the path length comprising two field free regions (d) between the two electric sectors and the 180° arc through the other electric sector. Furthermore, for each electric sector the object length let should equal the image distance $l_e''$. Hence, for each electric sector:

$$l_e'=l_e''=l_e \quad (9)$$

$$2\cdot l_e=2\cdot d+\pi\cdot r_e \quad (10)$$

Substituting $\Phi_e=\pi$ and $l_e'=l_e''=l_e$ into Eqn. 6 above gives $l_e=0.929\ r_e$. Therefore, no exact solution with positive values of d exists for Eqn. 10.

According to the preferred embodiment each of the two 180° electric sectors may be sub-divided into two or more electric sector segments with gaps between the electric sector segments. The sum of the sector angles of the electric sector segments is preferably 180°. This embodiment provides more degrees of freedom in the design of the mass analyser.

Figure 4:
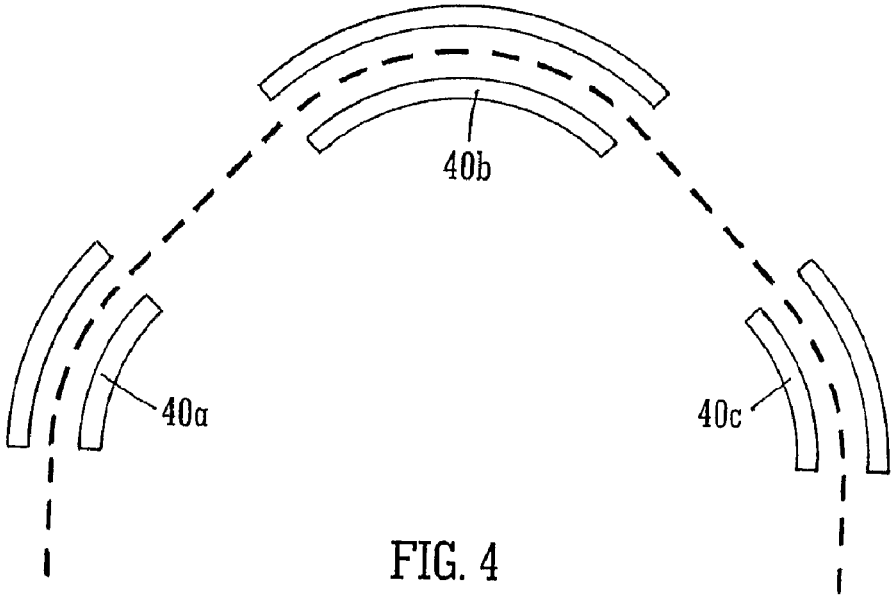
FIG. 4 shows an embodiment wherein a 180° electric sector is provided by two 45° electric sectors and a 90° electric sector.
Figure 5:
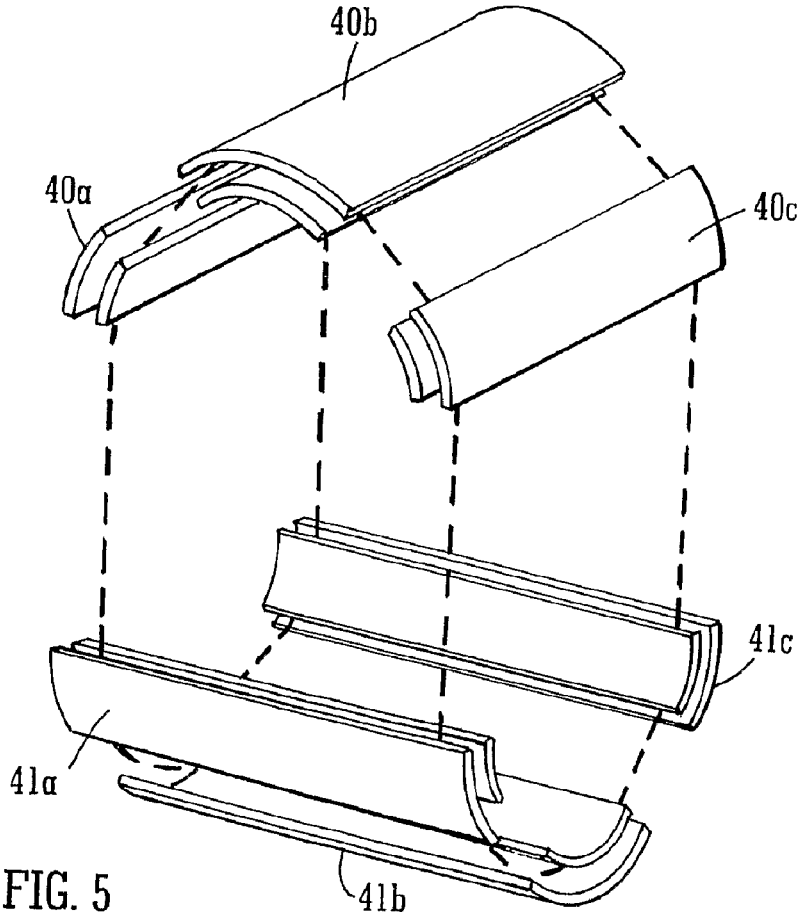
FIG. 5 shows an embodiment wherein three electric sector segments are arranged orthogonally to a further three electric sector segments.

FIGS. 4 and 5 illustrate a preferred embodiment wherein each electric sector has been subdivided into three smaller electric sector segments 40*a*-40*c* with sector angles of 45°, 90° and 45° respectively. The separation between each of the smaller electric sector segments is 0.9 $r_e$ and the separation between the two orthogonal electric sectors is $r_e$. For example, in FIG. 4 the radius of curvature $r_e$ of the ion trajectory in each electric sector is 100 mm, the gap between each of the smaller electric sector segments is 90 mm and the gap between the two orthogonal electric sector arrangements is 100 mm.

According to this embodiment the two orthogonal sets of electric sector segments provide complete stigmatic focussing with unity magnification for each lap that ions make of the mass analyser.

The example illustrated above with reference to FIGS. 4 and 5 is only one example of a design which provides complete stigmatic focussing with unity magnification for each lap of the circuit. Various alternative designs and modifications are also possible.

Although the present invention has been described with reference to the preferred embodiments, it will be understood by those skilled in the art that various changes in form and detail may be made without departing from the scope of the invention as set forth in the accompanying claims.

The invention claimed is:

1. A mass analyser comprising:

a first electric sector; and a second electric sector, wherein said second electric sector is arranged orthogonal to said first electric sector;

wherein said first electric sector is arranged to receive ions being transmitted in a first direction and is arranged to eject ions in a second direction which is opposite to said first direction; and wherein said second electric sector is arranged to receive ions being transmitted in a third direction and is arranged to eject ions in a fourth direction which is opposite to said third direction.

2. A mass analyser as claimed in claim 1, wherein said first electric sector comprises: (i) a single 180° electric sector; or (ii) a plurality of first electric sector segments each having a sector angle and wherein the sum of the sector angles of said plurality of first electric sector segments is 180°.

3. A mass analyser as claimed in claim 1, further comprising an ion inlet port provided in said first electric sector, wherein in use ions from an ion source are introduced into said mass analyser via said ion inlet port.

4. A mass analyser as claimed in claim 1, wherein said second electric sector comprises: a single 180° electric sector; or (ii) a plurality of second electric sector segments each having a sector angle and wherein the sum of the sector angles of said plurality of second electric sector segments is 180°.

5. A mass analyser as claimed in claim 1, further comprising an ion outlet port provided in said second electric sector, wherein in use ions exit said mass analyser via said ion outlet port.

6. A mass analyser as claimed in claim 1, further comprising one or more further electric sectors, wherein each one or more further electric sector comprises: (i) a single 180° electric sector; or (ii) a plurality of electric sector segments each having a sector angle and wherein the sum of the sector angles of said plurality of electric sector segments is 180°.

7. A mass analyser as claimed in claim 6, wherein said first electric sector is substantially elongated, and said second electric sector and said one or more further electric sectors are arranged in a staggered manner.

8. A mass analyser as claimed in any claim 1, further comprising:

one or more first ion-optical devices for focusing ions in a first direction; and one or more second ion-optical devices for focusing ions in a second direction which is orthogonal to said first direction.

9. A mass analyser as claimed in claim 8, wherein said one or more first and/or second ion-optical devices comprise: (i) one or more quadrupole rod sets; (ii) one or more electrostatic lens arrangements or (iii) one or more Einzel lens arrangements.

10. A mass analyser as claimed in claim 1, further comprising an ion detector and one or more deflection electrodes for deflecting ions onto the ion detector.

11. A mass analyser as claimed in claim 1, further comprising one or more detector plates wherein ions passing said one or more detector plates cause charge to be induced on to said one or more detector plates, and Fourier Transform analysis means for determining the time of flight of ions per cycle or orbit of the mass analyser.

12. A method of mass analysing ions comprising:

passing ions to a first electric sector, wherein said first electric sector is arranged to receive ions being transmitted in a first direction and is arranged to eject ions in a second direction which is opposite to said first direction; and than passing ions to a second electric sector, wherein said second electric sector is arranged orthogonal to the first electric sector, and is further arranged to receive ions being transmitted in a third direction and is arranged to eject ions in a fourth direction which is opposite to said third direction.

13. A closed-loop mass analyser, comprising:

a first electric sector; and a second electric sector, wherein said second electric sector is arranged orthogonal to said first electric sector;

wherein in a mode of operation ions perform one or more cycles or orbits of said mass analyser, and wherein during one cycle or orbit of said mass analyser ions:

(i) enter said second electric sector at a first position and are rotated by 180° in an x-z plane and emerge at a second position; and then (ii) pass through a field free region; and then (iii) enter said first electric sector at a first position and are rotated by 180° in a y-z plane and emerge at a second position; and then (iv) pass through a field free region; and then (v) enter said second electric sector at a third position and are rotated by 180° in an x-z plane and emerge at a fourth position; and then (vi) pass through a field free region; and then (vii) enter said first electric sector at a third position and are rotated by 180° in a y-z plane and emerge at a fourth position; and then (viii) pass through a field free region;

wherein said x-z plane is orthogonal to said y-z plane.

14. An open-loop mass analyser, comprising:

an elongated first electric sector;

a second electric sector; and a third electric sector, wherein said second and third electric sectors are arranged orthogonal to said first electric sector;

wherein in a mode of operation ions:

(i) enter said first electric sector at a first position and are rotated by 180° in a y-z plane and emerge at a second position; and then (ii) pass through a field free region; and then (iii) enter said second electric sector at a first position and are rotated by 180° in a x-z plane and emerge at a second position; and then (iv) pass through a field free region; and then (v) enter said first electric sector at a third position and are rotated by 180° in a y-z plane and emerge at a fourth position; and then (vi) pass through a field free region; and then (vii) enter said third electric sector at a first position and are rotated by 180° in a x-z plane and emerge at a second position;

wherein said x-z plane is orthogonal to said y-z plane.

* * * * *